US008407921B2

(12) United States Patent
Hu et al.

(10) Patent No.: US 8,407,921 B2
(45) Date of Patent: Apr. 2, 2013

(54) BACKLIT LOGO DEVICE

(75) Inventors: Da-Gang Hu, Shenzhen (CN); Shou-Ji Liu, Shenzhen (CN); Ze-Bo Lin, Shenzhen (CN); Feng Dai, Shenzhen (CN); Te-Sheng Jan, New Taipei (TW); Yu-Tao Chen, New Taipei (TW); Chun-Che Yen, New Taipei (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/172,865

(22) Filed: Jun. 30, 2011

(65) Prior Publication Data

US 2012/0260546 A1 Oct. 18, 2012

(30) Foreign Application Priority Data

Apr. 18, 2011 (CN) ..... 2011 1 0096445

(51) Int. Cl.
*G09F 13/00* (2006.01)

(52) U.S. Cl. ..... 40/541

(58) Field of Classification Search ..... 40/546, 40/547; 362/27, 613, 623–625, 558, 560
See application file for complete search history.

(56) References Cited

U.S. PATENT DOCUMENTS

2004/0004827 A1* 1/2004 Guest ..... 362/31

FOREIGN PATENT DOCUMENTS

CN 1581249 A 2/2005
CN 201561336 U 8/2010

* cited by examiner

*Primary Examiner* — Casandra Davis
(74) *Attorney, Agent, or Firm* — Altis Law Group, Inc.

(57) ABSTRACT

A backlit logo device includes an elongated light guiding member and two sources. The two light sources are arranged at opposite ends of the light guiding member. The light guiding member includes a display surface. The display surface includes a transparent logo so light from the light sources passes through the logo. The light guiding member further includes a light reflecting surface opposite to the display surface. The light reflecting surface includes a plurality of light diffusing portions formed in a middle portion of light reflecting surface. The light diffusing portions are configured to diffusely reflect the light from the light sources to the display surface.

1 Claim, 3 Drawing Sheets

BACKLIT LOGO DEVICE

BACKGROUND

1. Technical Field

The present disclosure relates to a backlit logo device.

2. Description of Related Art

Light emitting diodes (LEDs) are widely used in electronic devices to light logos (e.g., a mark, a label, or a brand) thereon. The LEDs are small and have a narrow light emitting angle. LEDs usually are positioned at two opposite ends of the logos, thus the light in the section of the logos in the middle position is dim, and the logos cannot be evenly displayed.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
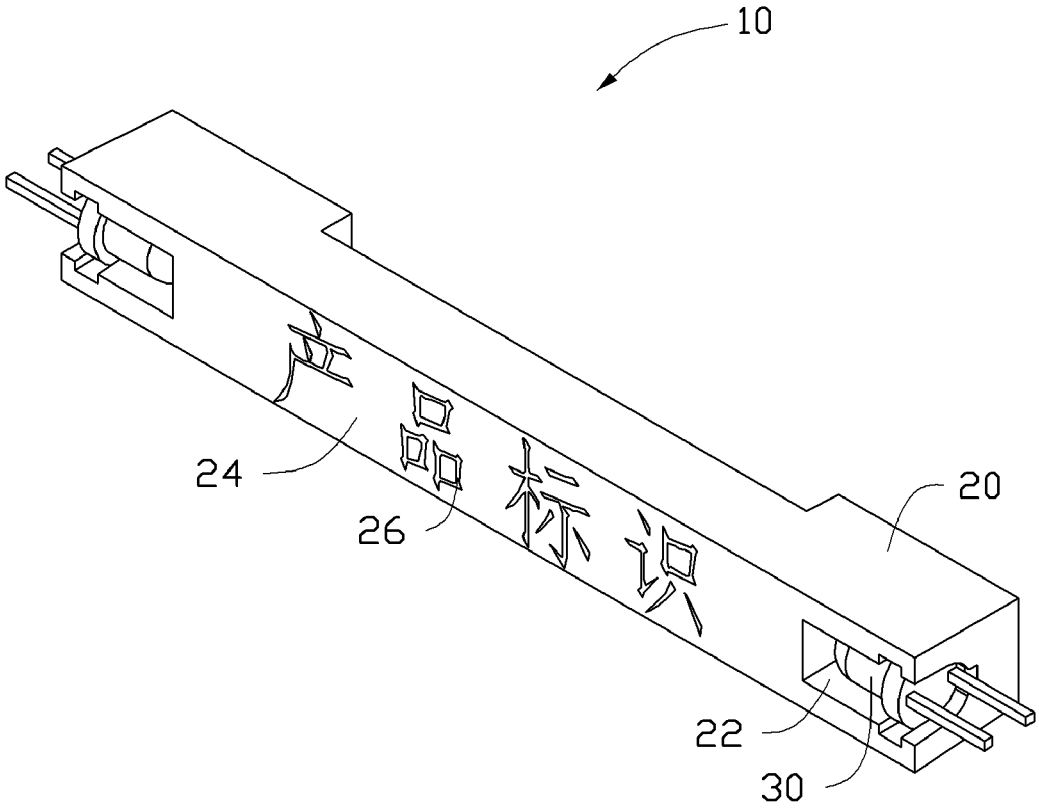
FIG. 1 is an isometric view of a backlit logo device according to an exemplary embodiment.

Referring to FIG. 1, a backlit logo device 10 that is installed in an electronic device to serve as a logo according to an exemplary embodiment is shown. The logo device 10 includes a transparent light guiding member 20 and two LEDs 30. The light guiding member 20 is a transparent plastic sheet. The light guiding member 20 can be made of plexiglas. In the embodiment, the light guiding member 20 is substantially cuboid. Two cavities 22 are defined at two opposite ends of the light guiding member 20. The two LEDs 30 are respectively received in the two cavities 22. The LEDs 30 are electrically connected to a circuit board in the electronic device to be powered by the circuit board. The light guiding member 20 includes a display surface 24. The display surface 24 includes a transparent logo 26. The other part of the display surface 24 is opaque. Light from the LEDs 30 is allowed to propagate the logo 26.

Figure 2:
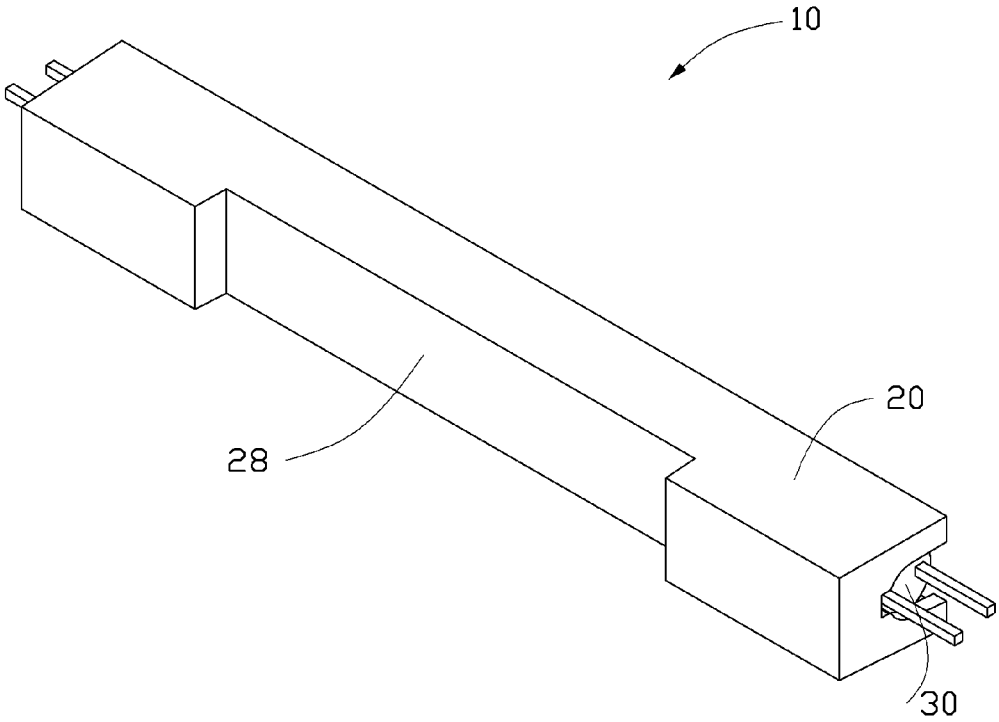
FIG. 2 is similar to FIG. 1, but viewed from a different viewpoint.
Figure 3:
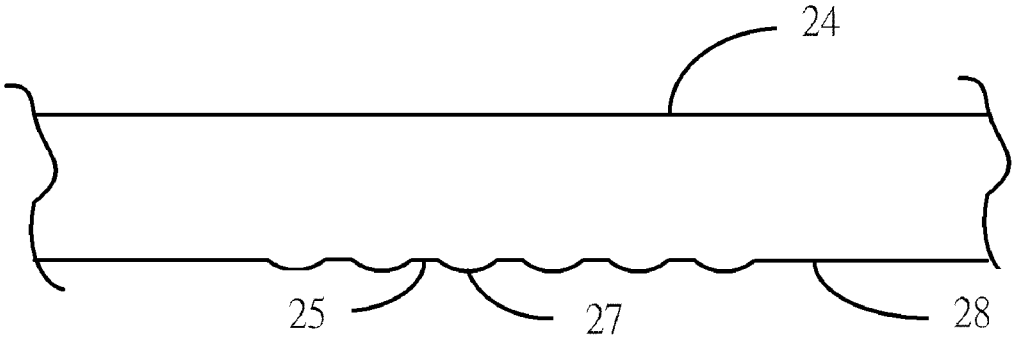
FIG. 3 is a cross-sectional view of the light guiding member of the backlit logo device in FIG. 2.

Referring to FIGS. 2 and 3, the light guiding member 20 further includes a light reflecting surface 28 opposite to the display surface 24. The light reflecting surface 28 is formed with a plurality of light diffusing portions 27 in its middle portion. The light diffusing portions 27 protrude from the light reflecting surface 28. The roughness of the light reflecting surface 28 in the middle portion is thus increased. The light diffusing portions 27 are capable of diffusely reflecting the light from the LEDs 30 to the display surface 24. Therefore, the light from the LEDs 30 refracted through the light guiding member 20 is decreased. Correspondingly, the display surface 24 in its middle portion is lit to maximum, thus the brightness of the middle portion of the display surface 24 is close or equal to that of the two opposite ends of the display surface 24. In this way, the logo 26 on the display surface 24 has well distributed light.

In the embodiment, each light diffusing portion 27 is an arc-shaped profile. In an alternative embodiment, each reflective portion 27 can be triangle profile or other suitable shapes profile. The light diffusing portions 27 are spaced from each other. A flat surface 25 that is formed between each adjacent two light diffusing portions 27 is capable of decreasing the light reflection, thereby, preventing excess light from reflecting to the display surface 24.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A backlit logo device comprising:

an elongated light guiding member comprising a display surface, a transparent logo formed on the display surface; and two light sources arranged at opposite ends of the light guiding member;

wherein the light guiding member further comprises a light reflecting surface opposite to the display surface, and a plurality of light diffusing portions formed in a middle portion of the light reflecting surface, each of the light diffusing portions has an arc-shaped profile, the light reflecting surface is a flat surface and the light diffusing portions protrude from the light reflecting surface, the light diffusing portions are configured to diffusely reflect light from the light sources to the display surface.

* * * * *